US006135348A

United States Patent [19]

Hayes

[11] Patent Number: 6,135,348

[45] Date of Patent: Oct. 24, 2000

[54] APPARATUS AND METHODS FOR CALCULATING GAMMA RADIOGRAPHY VARIABLES

[76] Inventor: Paul T. Hayes, 3680 S. 1100 E., Salt Lake City, Utah 84106

[21] Appl. No.: 09/198,923

[22] Filed: Nov. 24, 1998

Related U.S. Application Data

[60] Provisional application No. 60/066,651, Nov. 24, 1997.

[51] Int. Cl.[7] ..... G06C 27/00

[52] U.S. Cl. ..... 235/78 R

[58] Field of Search ..... 235/78 R, 74, 235/78 M, 88 R

[56] References Cited

U.S. PATENT DOCUMENTS

| | | | |
|---|---|---|---|
| 2,411,491 | 11/1946 | Williams | 235/78 R X |
| 2,484,366 | 10/1949 | Wilson | 235/88 R X |
| 3,050,249 | 8/1962 | Awramik, Jr. et al. | 235/78 R X |
| 3,700,162 | 10/1972 | Gaggero et al. | 235/78 R X |
| 3,822,038 | 7/1974 | Olson | 235/88 R X |
| 5,828,723 | 10/1998 | Mariscotti | 378/59 |

*Primary Examiner*—Michael G Lee
*Attorney, Agent, or Firm*—Trask Britt

[57] ABSTRACT

An apparatus and method for calculating gamma radiography variables is provided. The apparatus includes a base with a circular logarithmic time scale displayed thereon, a first disk concentric and rotatably coupled to said base for displaying a circular logarithmic radiation source scale and a circular logarithmic source-to-film distance scale, a second disk displaying a circular nearly linear steel thickness scale and a radial tick mark F, and a third disk displaying a radial baseline mark and a plurality of film type marks. The method disclosed allows calculation of exposure time from known quantities: film type, source-to-film distance, steel thickness, radiation source type and strength.

16 Claims, 5 Drawing Sheets

APPARATUS AND METHODS FOR CALCULATING GAMMA RADIOGRAPHY VARIABLES

CROSS-REFERENCE TO RELATED APPLICATION

This application claims the benefit of U.S. provisional application Ser. No. 60/066,651, filed Nov. 24, 1997.

BACKGROUND OF THE INVENTION

1. Field of The Invention

This invention relates to devices used in gamma radiography. More particularly, this invention relates to a calculator and related method of solving for one of five gamma radiographic variables useful in developing radiographs.

2. Description of The Related Art

Gamma radiography is useful for performing nondestructive tests of various objects, including structural members, such as reinforced concrete beams and columns, steel girder welds, reinforced concrete walls and floors, piping, pressure vessels, castings and the like. Gamma radiography involves irradiating an object of interest with a gamma radiation source (e.g., Iridium 192 ($Ir^{192}$), Cobalt 60 ($Co^{60}$), etc.). The gamma particles from the gamma radiation source pass through, or are absorbed by, the object of interest and strike a photographic film target. The latent image on the film target, also known as a radiograph or radiogram, is a 2-dimensional representation of the density of the object of interest. Generally, highly exposed (dark) regions of the radiograph indicate low density, and conversely, underexposed (light) regions represent high density. Thus, undesirable voids or discontinuities in a steel girder weld might appear as a dark region where a light region should have appeared.

When making a radiograph, several variables must be taken into account, including thickness and material of the object of interest, the type of film used to develop the radiograph, the distance between the radiation source and the film target, the intensity of the radiation source (or source strength), the desired film exposure density, the length of time of the exposure and the relative strength or weakness of the chemicals being used to develop the radiograph.

One prior art approach to solving for exposure time using either $Ir^{192}$ or $Co^{60}$ radiation sources is the GAMMA RADIATION EXPOSURE CALCULATOR, from JEM Manufacturing Corporation. Using this prior art slide-rule device, one matches the desired exposure density to the age of the radiation source. Then the source-to-film distance is matched against a steel thickness scale. Finally, the exposure time is read from the corresponding radiation source strength. One drawback with this apparatus is that one must know the correct exposure per hour (in Roentgens) for the particular type of film being used. Put another way, if the user of this apparatus only knows what type of film is being used, and not the radiation dose, he cannot calculate exposure time. The apparatus is also incapable of adjusting for strong or weak developing chemicals.

A circular calculator for the solution of radiation penetration problems is disclosed by U.S. Pat. No. 3,700,162 to Gaggero et al. The Gaggero et al. patent teaches solving for one of five variables given the other four. The five variables of interest in the Gaggero et al. patent are: source intensity, I, usually measured in Curie, sometimes in Becquerel; exposure time, T, usually measured in minutes; thickness of the object of interest, L, source-to-target distance, K, typically measured in inches; and radiation dose at the target (film) position, R, typically measured in Roentgens, or sometime in Seiverts. As disclosed in Gaggero et al., R can be expressed as a function of the other four variables:

$$R=I\cdot T\cdot K^{-2}F(L), \quad (1)$$

where F(L) is the radiation dose for unit values of the variables I, T and K. F(L) depends on the energy spectrum of the radiation source, and on the material composition of the target of interest. The Gaggero et al. patent does not disclose the solution of exposure time, T, from variables I, K, L, and film type. Furthermore, Gaggero et al. notes that "type of film" and "developing conditions" are variables that affect quick determination of exposure time required to obtain radiographs of good quality. However, Gaggero et al. suggests that such parameters as "type of film" and "developing conditions" are "not continuously varying parameters and hence they are somewhat difficult to handle" thus, teaching away from their use.

Thus, there is a need in the art for methods and apparatus for calculating gamma radiography variables which employ or consider the variable of film type, and which compensate for film developing conditions (i.e., relative chemical strength).

BRIEF SUMMARY OF THE INVENTION

In accordance with the present invention, apparatus and methods for calculating one gamma radiography variable given all of the others is disclosed. The gamma radiography variables are film type, object thickness, source-to-film distance, source strength, and exposure time. The apparatus and methods are capable of compensating or adjusting for exposure density and relative developing chemical strength.

The apparatus of the invention comprises a base and three members. In one possible configuration of the invention, for example, the base displays a logarithmic time scale, a first member displays a logarithmic source strength scale and a logarithmic source-to-film distance scale, a second member displays an object thickness scale and a reference F mark, and a third member displays markings, corresponding to various film types and a radial film type mark.

Methods for calculating exposure time according to this invention are also disclosed. Using an apparatus in accordance with this invention, the type of film being used to shoot the radiograph is selected and the reference F mark is then aligned with the indicator of the type of film selected. The source-to-film distance is then determined and the indicia marker is aligned with the appropriate object thickness indicia marker corresponding to the thickness of the object. The exposure time is then viewed on the apparatus which corresponds to the radiation source strength being used.

An alternative method for calculating exposure time according to this invention would be to line up the first and second disks (i.e., match thickness with source-to-film distance), then select the correct film type, followed by reading the exposure time corresponding to the radiation source strength being used.

BRIEF DESCRIPTION OF THE DRAWINGS

In the drawings, which illustrate what is currently regarded as the best mode for carrying out the invention, and in which like reference numerals refer to like parts in different views or embodiments.

DETAILED DESCRIPTION OF THE INVENTION

The following detailed description discloses apparatus and methods for calculating gamma radiation variables. Gamma radiography variables of this invention include film type, object thickness, source-to-film distance, source strength, and exposure time. A generic apparatus in accordance with this invention includes a base and three members, wherein the three members are movable relative to one another and to the base. Scales of the gamma radiography variables of this invention appear on the base and three members of the apparatus. These scales can be arbitrarily dimensioned as long as the relationship between the scales displayed on particular members remains the same. Specific embodiments of an apparatus in accordance with this invention may include various circular and linear embodiments. Methods for calculating one gamma radiography variable given the other four are also disclosed.

Figure 1:
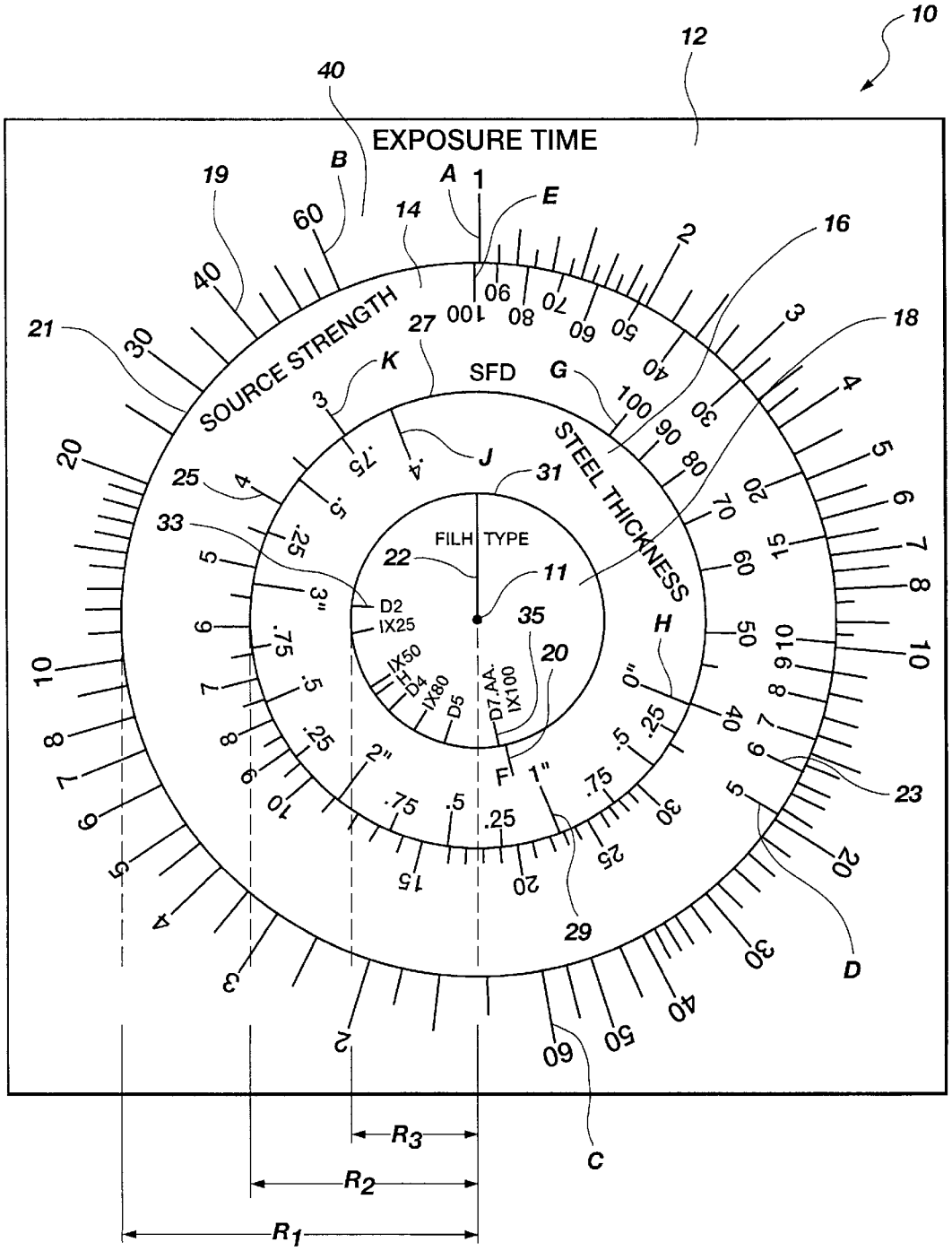
FIG. 1 is a plan view of a circular apparatus for calculating gamma radiography variables configured for $Ir^{192}$ radiation sources in accordance with this invention.

As shown in FIG. 1, a circular embodiment of an apparatus 10 in accordance with this invention and configured for $Ir^{192}$ radiation sources, includes a base 12, a first disk 14 of radius $R_1$, a second disk 16 of radius $R_2$, and a third disk 18 of radius $R_3$, wherein $R_3<R_2<R_1$. The base 12, first disk 14, the second disk 16 and the third disk 18 share a common center point 11 about which the first disk 14, the second disk 16 and the third disk 18 may freely rotate relative to the base 12.

Referring to FIG. 1, a plan view of a circular embodiment of an apparatus 10 for calculating gamma radiography variables configured for $Ir^{192}$ radiation sources is shown. The circular embodiment 10 includes a base 12, bearing the label "EXPOSURE TIME", with a circular logarithmic time scale of radius $R_1$ (hereinafter logarithmic time scale) displayed thereon. The logarithmic time scale includes radial tick marks 19 emanating outward from a circle 21 of radius $R_1$. The logarithmic time scale begins with "1 " fixed at a zero reference point A, shown here as a 12 o'clock position, and increases clockwise to "60" at point B, shown here at an 11 o'clock position, encompassing two orders of magnitude in time. The first order of magnitude of time begins with "1" at a zero reference point A and increases clockwise to "60" at point C, shown here at about a 5:30 o'clock position. The second order of magnitude of time begins with "60" at point C and increases clockwise to "60" at zero reference point A. Thus, in this particular embodiment, the logarithmic time scale occupies approximately 11/12 of a complete circle. The first order of magnitude of the logarithmic time scale may represent minutes or seconds and the second order of magnitude may represents hours or minutes of exposure time, as needed.

FIG. 1 also shows a first disk 14, bearing a label "SOURCE STRENGTH" of radius $R_1$ encircled within the time scale displayed on the base 12. The first disk 14 is positioned concentric, and rotatable relative, to the logarithmic time scale fixed on base 12. The first disk 14 displays a circular logarithmic radiation source strength scale (hereinafter radiation source strength scale) beginning with "5" at point D and increasing counterclockwise to "100" at point E about the circumference of the first disk 14. The radiation source strength scale is marked with radial tick marks 23 emanating inward from a circle 21 of radius $R_1$, (i.e., from the circumference of the first disk 14). The radiation source strength scale occupies approximately 3/8 of a complete circle in this particular embodiment.

The first disk 14 also displays a circular logarithmic source-to-film distance scale (hereinafter source-to-film distance scale) beginning with "3" at point K and increasing counterclockwise to "100" at point G. The source-to-film distance scale is marked with radial tick marks 25 emanating outward from a circle 27 of radius $R_2$ within, and concentric to, the radiation source strength scale. The source-to-film distance scale occupies approximately 5/6 of a complete circle in this particular embodiment.

Figure 4:
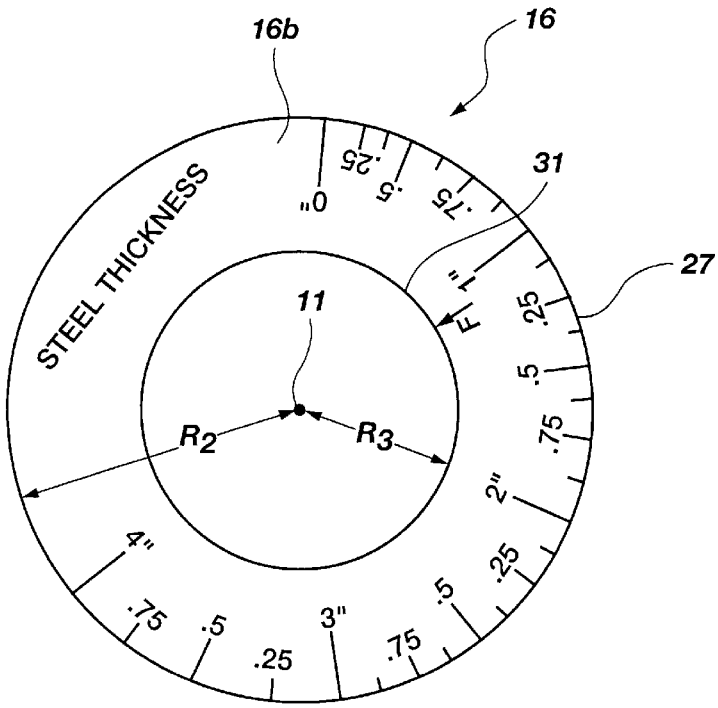
FIG. 4 is a plan view of a second disk of a circular embodiment of the apparatus of the invention for calculating gamma radiography variables configured for $Ir^{192}$ radiation sources.

FIG. 1 also illustrates a second disk 16, bearing a label "STEEL THICKNESS" of radius $R_2$ encircled within the radiation source strength scale displayed on the first disk 14. FIG. 4 illustrates the second disk 16 alone with center point 11, an inner circle 31 of radius $R_3$ and an outer circle 27 of radius $R_2$. Referring back to FIG. 1, the second disk 16 is located concentric, and rotatable relative, to the base 12 and the first disk 14. The second disk 16 displays a circular, nearly linear, thickness scale (hereinafter thickness scale) beginning with 0 inches at point H and increasing clockwise in quarter inch increments to 4 inches along a circumference of the second disk 16. The region of the thickness scale within the range 0 inches to 0.5 inches is nonlinear as shown in FIG. 1, and is linear thereafter (i.e., within the range 0.5 inches to 4 inches). The thickness scale is marked with radial tick marks 29 emanating inward from the circumference of a circle 27 of radius $R_2$ of the second disk 16. The thickness scale occupies approximately 2/3 of a complete circle in this particular embodiment.

The second disk 16 also displays a radial tick mark F 20 shown as emanating from a circle of radius $R_3$ within, and concentric to, the thickness scale. The radial tick mark F 20 is located radially between 1 inches and 1.25 inches as shown on the thickness scale.

FIG. 1 also illustrates a third disk 18 of radius $R_3$. A radial baseline mark 22, bearing the label "FILM TYPE", is shown lined up with the zero reference point A. The third disk 18 displays a circular film type scale (hereinafter film type scale) along a circle 31 of radius $R_3$, with radial tick marks, labeled with various film types beginning at "D2" 33 and proceeding counterclockwise, and irregularly, to "D7, AA, IX100" 35. Film types D2, D4, D5, and D7 are all manufactured by AGFA. Film types IX25, IX50, IX80, and IX100 are all manufactured by FUJI. Film types M and AA are manufactured by KODAK. While those film types illustrated as radial tick marks on the third disk 18 are the most common types of film used for making radiographs of steel objects, other types of film may be used with the invention and marked on the third disk 18 based on relative film exposure speed.

Generally, the exposure speed of film is determined by the size of the silver bromide grains in the film and the larger the silver bromide grains, the faster the film speed. During exposure, gamma radiation oxidizes these individual silver bromide grains to form individual spots of a picture in the radiograph. The "D7, AA, IX100" films are all coarse grained, and thus, relatively fast films. Whereas, D2 is a very fine grained film, and thus, relatively slow. Hence, the film type scale displayed on the third disk 18 incorporates film speed.

A dose of one Roentgen (R) of radiation per hour is required to expose D7 film to a 2.0 density. A dose of 13R per hour is required to expose D2 film to a 2.0 density. Thus, the film type scale ranges from 1R for D7, AA, IX100 film to 13R for D2 film. The radial baseline mark 22 is lined up with the zero reference point A, to obtain a 2.0 density exposure with all of the above-referenced film types. A film exposure density of 2.0 is considered standard.

An important feature of the invention is that the radial baseline mark 22 is rotationally adjustable, relative to the zero reference point A, to compensate for weak or strong chemicals and/or obtaining a more desirable film density. For example, if the third disk is rotated clockwise, a higher (darker) density will result, and conversely, when the third disk is rotated counterclockwise, a lower (lighter) density will result. The inventor has discovered that a density of between 2.75 and 3.0 is usually the preferred exposure density for radiographs because undesirable voids and discontinuities tend to be more visible than in a radiograph of 2.0 density. Thus, a clockwise adjustment between 0° up to about 45°, measured relative to the zero reference point A will provide optimum picture quality. Conversely, a counterclockwise rotation, between 0° about −15° relative to the zero reference point A, may be used to obtain a lighter density radiograph where particularly strong developing chemicals are being used.

Figure 2:
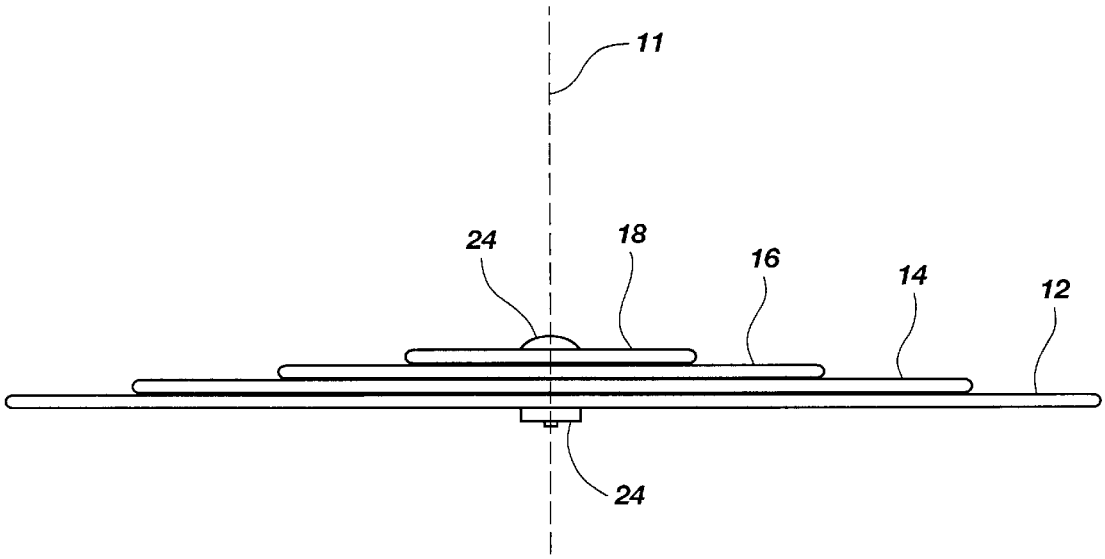
FIG. 2 is a side view of a first embodiment of the apparatus shown in FIG. 1.

FIG. 2 shows a side view of a first embodiment of an apparatus 10 for calculating gamma radiography variables. The first disk 14 lies adjacent to the base 12. The second disk 16 lies adjacent to the first disk 14, and the third disk 18 lies adjacent to the second disk 16 and furthest away from the base 12. A rotatable securing means 24 for rotatably securing the base 12, the first disk 14, the second disk 16 and the third disk 18 to each other, is shown at the center point 11. The center point 11 is shown pictorially as a dotted line passing through said rotatable securing means 24). Any type of rotatable securing means 24 may be used with this embodiment. A nut and bolt 24 as illustrated with washers (not shown) separating each disk and base 12 is merely one exemplary rotatable securing means 24. Other means for performing this function will be readily apparent to one skilled in the art, and thus, will not be further discussed hereinafter.

Figure 3:
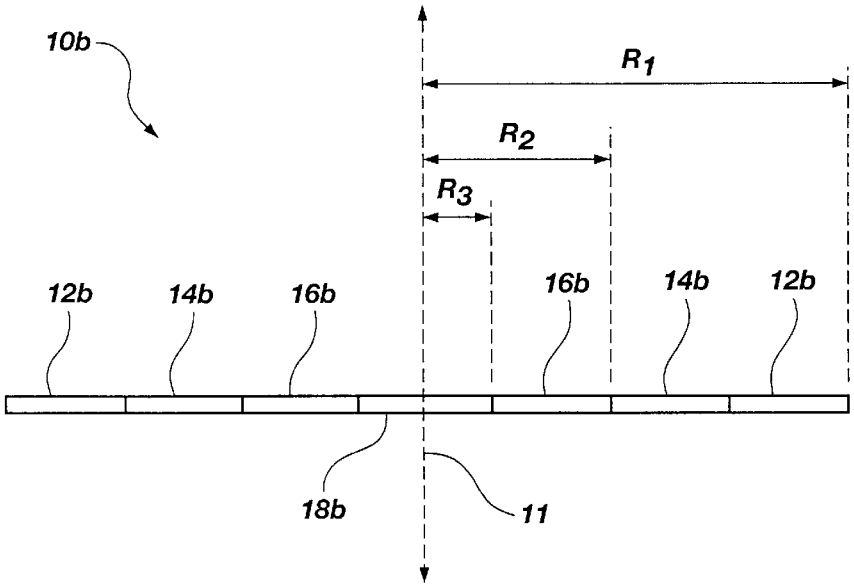
FIG. 3 is a cross-section of second embodiment of the apparatus shown in FIG. 1.

FIG. 3 shows a cross-section of a second circular embodiment of an apparatus 10*b* for calculating gamma radiography variables (hereinafter second circular embodiment 10*b*). In this second circular embodiment 10*b*, a third disk 18, surrounded by an annular second ring 16*b*, which is in turn surrounded by an annular first ring 14*b*, which is firmly surrounded by a base 12*b*. A means (not shown) for rotatably coupling the base 12 to the first ring 14*b*, and for rotatably coupling the first ring 14*b* to the second ring 16*b*, and for rotatably coupling the second ring 16*b* to the third disk 18 such as, for example, a bushing or bearing may be provided. Other means for performing the rotatable coupling will be readily apparent to one skilled in the art, and thus, will not be further discussed hereinafter.

Figure 5:
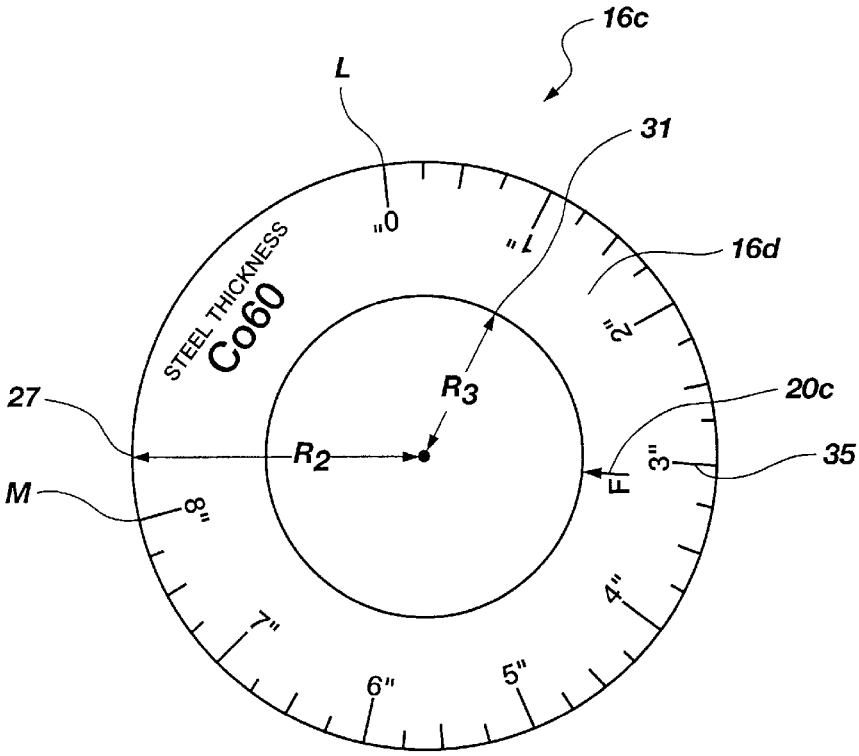
FIG. 5 is a plan view of a second disk of a circular embodiment of the apparatus of the invention for calculating gamma radiography variables configured for Co60 radiation sources.

FIG. 5 shows an embodiment of a $Co^{60}$ second disk 16*c*, or alternatively a $Co^{60}$ second annular ring 16*d*, for use with $Co^{60}$ radiation sources which may replace the second disk 16, or alternatively the second annular ring 16*b*, respectively, as described in the first and second embodiments above for $Ir^{192}$ radiation sources. By replacing the second disk 16 of apparatus 10 with a $Co^{60}$ second disk 16*c*, a third circular embodiment of an apparatus 10*c* (not shown) for calculating gamma radiography variables (hereinafter third circular embodiment 10*c*) is obtained. Similarly, by replacing the second annular ring 16*b* of apparatus 10*b* with a $Co^{60}$ second annular ring 16*d*, a fourth circular embodiment of an apparatus 10*d* (also not shown) for calculating gamma radiography variables (hereinafter fourth circular embodiment 10*d*) is obtained. Generally, $Co^{60}$ provides a stronger source of gamma radiation for exposing radiographs. The inventor has discovered that $Ir^{192}$ radiation sources are most useful when radiographing steel with a thickness three inches or less. Additionally, the type of radiation source required for a given thickness of object may be regulated by administrative or regulatory code, especially in the nuclear energy industry. For steel objects greater than three inches of thickness, $Co^{60}$ provides a preferred source of gamma radiation for making such radiographs.

Since the scale displayed on a $Co^{60}$ second disk 16*c* is the same as that displayed on a $Co^{60}$ second annular ring 16*d*, only the $Co^{60}$ second disk 16*c* will be explained in detail herein. The $Co^{60}$ second disk 16*c*, bearing label "STEEL THICKNESS Co60", displays a linear thickness scale beginning with 0 inches at a point L and increasing clockwise to 8 inches at a point M along an outer circumference (of a circle 27 of radius $R_2$) of the $Co^{60}$ second disk 16*c*. The thickness scale is marked with radial tick marks 35 emanating inward from the circumference of a circle 27 of radius $R_2$ of the $Co^{60}$ second disk 16*c*. In the third circular embodiment 10*c*, the thickness scale occupies approximately ¾ of a complete circle on the $Co^{60}$ second disk 16*c*. The $Co^{60}$ second disk 16*c* also displays a radial tick mark F 20*c* shown as a radial arrow pointing to a circle 31 of radius $R_3$ within, and concentric to, the thickness scale. The radial tick mark F 20*c* is located radially between 3" and 3.25 " as shown on the thickness scale of the $Co^{60}$ second disk 16*c*. The apparatus 10 of the invention may include interchangeable second disks (i.e., second disk 16 and $Co^{60}$ second disk 16*c*) as a kit. Similarly, embodiment 10*b* of the invention may include interchangeable second annular rings (i.e., second annular ring 16*b* and $Co^{60}$ second annular ring 16*d*) as a kit.

Figure 6:
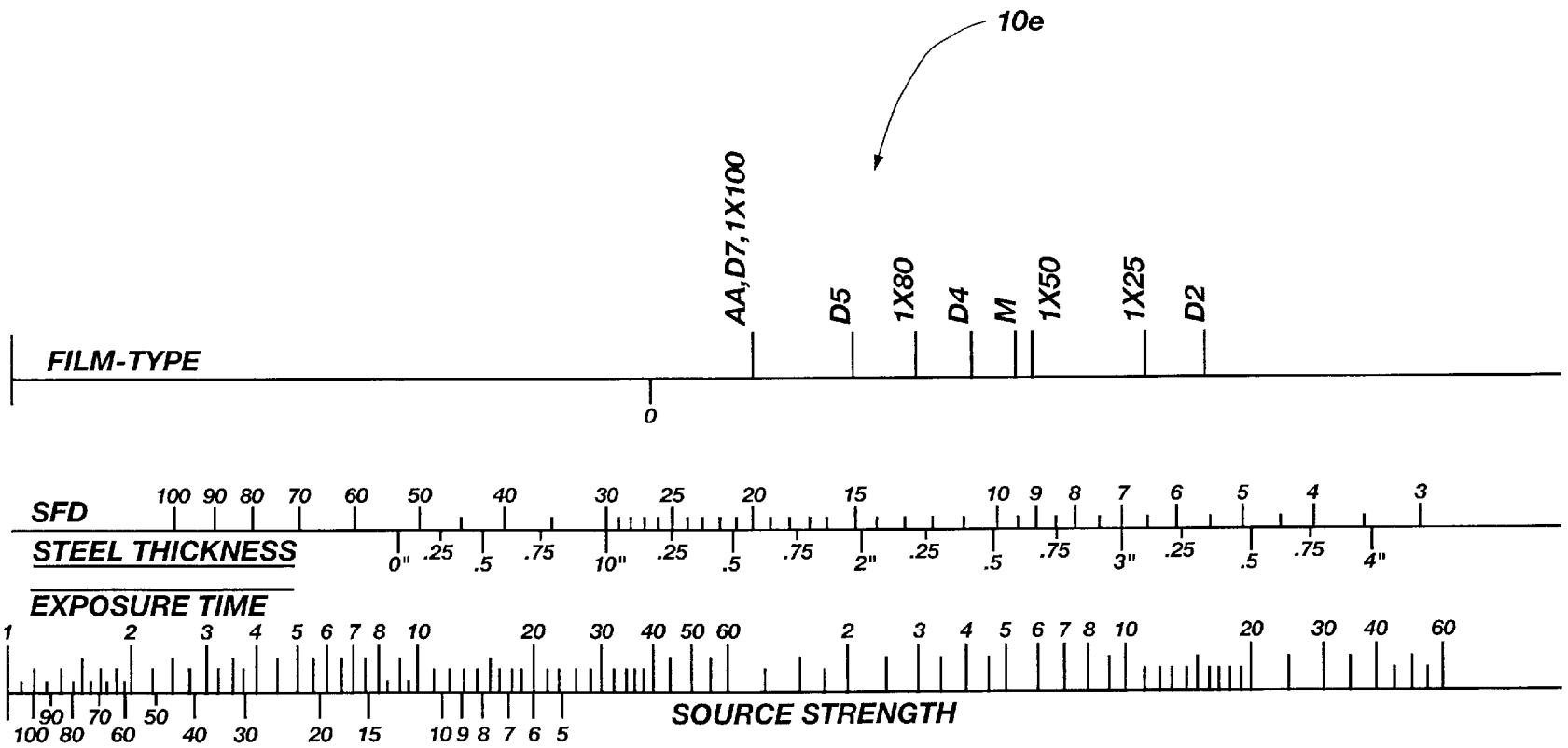
FIG. 6 is a plan view of a linear apparatus for calculating gamma radiography variables configured for $Ir^{192}$ radiation sources in accordance with this invention.
Figure 7:
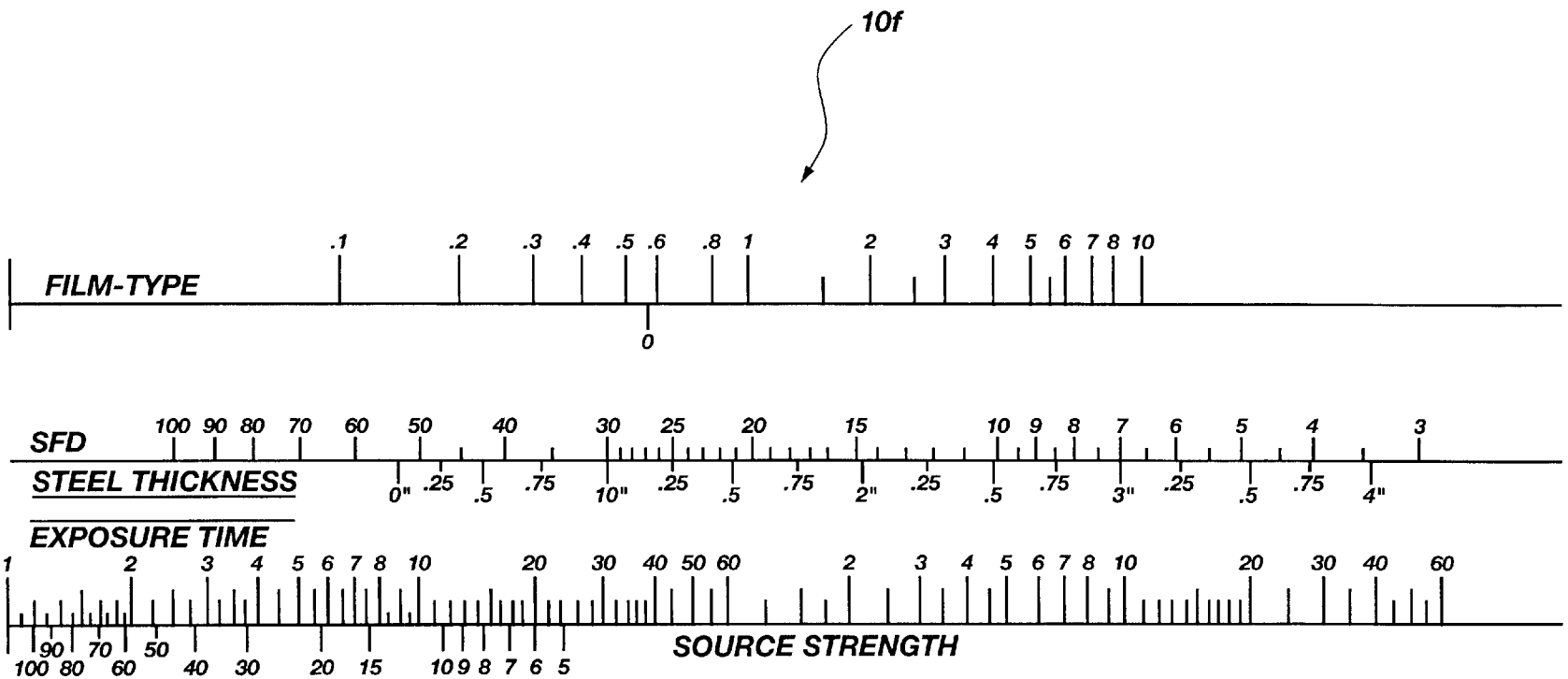
FIG. 7 is a plan view of a linear apparatus for calculating gamma radiography variables configured for $Ir^{192}$ radiation sources where the film type scale shown in FIG. 6 has been converted to R-factors.

The circular embodiments of the apparatus 10 of this invention as described above can be arranged in a linear slide rule form. Referring to FIG. 6, a linear apparatus 10*e* for calculating gamma radiography variables configured for $Ir^{192}$ radiation sources is illustrated. Referring to FIG. 7, a plan view of a linear apparatus 10*f* for calculating gamma radiography variables configured for $Ir^{192}$ radiation sources where the film type scale of FIG.6 has been converted to R-factors is illustrated.

The method by which an apparatus 10 for calculating gamma radiography variables is used to calculate exposure time will be illustrated by the following example. Suppose one wants to calculate exposure time for a given radiograph using KODAK M type film, to shoot radiograph of density 2.0 of a plate of steel 2" thick, where the source-to-film distance for the particular radiograph is twenty inches, given an $Ir^{192}$ radiation source of strength 70 Curie. To begin, make sure that the radial baseline mark 22 on the third disk 18 is at the zero reference point A position. Next, select the M film type mark from the plurality of different film types marked on the film type scale on the third disk 18 and rotate the second disk 16 until the radial tick mark F 20 lines up with the M film type mark on the third disk 18. Then, while holding the second disk 16 and third disk 18 in place, rotate the first disk 14 until the source-to-film scale mark for 20 inches lines up with the two inch mark on the thickness scale of the second disk 16. Finally, read the exposure time displayed on the logarithmic time scale which corresponds to the 70 Curie mark on the source strength scale of the first disk. The exposure time will be about 20 minutes. This should result in a radiograph of density of 2.0. Where a darker density is preferred, adjust the radial baseline mark 22 slightly clockwise, recalculate the exposure time, and re-shoot the radiograph. In this fashion, the calculator can be calibrated to adjust for the preferred density and to compensate for weak (or strong) developing chemicals.

The logarithmic time scale displayed on the base 12 can be converted to seconds and minutes rather than minutes and hours. By way of example, suppose one is radiographing ¾" steel with AGFA's D5 film, to a 2.0 density, with a $Ir^{192}$ radiation source of strength 80 Curie, at a source-to-film distance of fifteen inches. With the radial baseline mark 22 lined up with the zero reference point A, rotate the radial tick mark F 20 on the second disk 16 until lines up with the D5 film type mark on the third disk 18. Then, while holding the second disk 16 and third disk 18 in place, rotate the first disk 14 until the source-to-film scale mark 15 lines up with the 0.75 inches mark on the thickness scale of the second disk 16. Note that the source strength mark 70 appears in the unmarked region 40 of the logarithmic time scale (between sixty hours and one minute in FIG. 1). Note also that the "6" Curie mark lines up with approximately the "10" minute mark. Rotate the first disk 14 until the 6 Curie mark lines up with the 10 hour mark of the logarithmic time scale. Then read the time scale from the logarithmic time scale corresponding to a 70 Curie radiation source strength. Approximately 50 seconds will be shown. Thus, a clockwise rotation of the first disk 14 will convert minutes to seconds and hours to minutes.

The second disk 16, or alternatively, the second annular ring 16*b*, illustrated in FIG. 4, The $Co^{60}$ second ring 16*c* and the $Co^{60}$ second annular ring 16*d* illustrated in FIG. 5 are all calibrated for iron and all types of steel. The following table gives approximate conversion factors (exposure time multipliers) for other types of materials.

| Material | $Ir^{192}$ Radiation Sources | $Co^{60}$ Radiation Sources |
|---|---|---|
| Aluminum | 0.35 | 0.35 |
| Aluminum Alloy | 0.35 | 0.35 |
| Titanium | 0.9 | 0.9 |
| Iron/all Steels | 1.0 | 1.0 |
| Copper | 1.1 | 1.1 |
| Zinc | 1.1 | 1.0 |
| Brass | 1.1 | 1.0 |
| Inconel X | 1.3 | 1.3 |
| Zirconium | 1.2 | 1.0 |
| Lead | 4.0 | 2.3 |
| Uranium | 12.6 | 3.4 |

Note that steel has a multiplier of 1.0, since it is the baseline for which the inventive apparatus 10 is designed. Thus, for example, if one is shooting an object of interest that is made of aluminum with either type of radiation source, the calculated exposure time should be multiplied by 0.35 to arrive at an approximately correct exposure time.

Any embodiment described above may have a reference table such the above table printed on a back surface of an apparatus member such as a base 12, or provided as a reference card.

Although this invention has been described with reference to particular illustrated embodiments, the invention is not limited to the embodiments described. For example, a simple conversion of units, say from Curie to Becqurel, or from minutes to fractions of an hour, or from film type to R-factors all would be within the scope of the invention. Rather, it should be understood that the embodiments described herein are merely exemplary and that a person skilled in the art may make many variations and modifications without departing from the spirit and scope of the invention as defined by the following claims.

What is claimed is:

1. A calculator for solving gamma radiography variables comprising:

a base for displaying a time scale;

a first disk rotatably coupled to said base for displaying a radiation source strength scale opposed to said time scale and for displaying a source-to-film distance scale;

a second disk rotatably coupled to said base and said first disk for displaying a thickness scale opposed to said source-to-film distance scale and for displaying a radial F mark; and a third disk rotatably coupled to said base, said first disk and said second disk for displaying a film type scale opposed to said radial F mark and for displaying a radial baseline mark.

2. The calculator for solving gamma radiography variables of claim 1, wherein said second disk is dimensioned for a radiation source selected from the group comprising $Ir^{192}$ and $Co^{60}$.

3. A circular calculator for solving gamma radiography variables comprising:

a base for displaying a logarithmic time scale outside a circle of radius $R_1$, wherein said logarithmic time scale begins at a zero reference point;

a first disk of radius $R_1$ adjacent to, and rotatably coupled to, said base and concentric with said circular logarithmic time scale for displaying a circular logarithmic radiation source strength scale and for displaying a circular logarithmic source-to-film distance scale;

a second disk of radius $R_2$ adjacent and concentric to said first disk and rotatably coupled to both said first disk and said base for displaying a circular thickness scale and for displaying a radial tick mark F, wherein $R_2<R_1$; and a third disk of radius $R_3$ adjacent and concentric to said second disk and rotatably coupled to said base, said second disk and said first disk for displaying a radial baseline mark and for displaying a plurality of film type marks, wherein $R_3<R_2$.

4. The circular calculator of claim 3, wherein said circular logarithmic time scale includes a plurality of radial tick marks emanating outward from a circle of radius $R_1$, wherein some of said plurality of radial tick marks are labeled beginning with "1" at a zero reference point and increasing clockwise ending with "60".

5. The circular calculator of claim 3, wherein said circular logarithmic radiation source strength scale includes a plurality of radial tick marks emanating inward from a circle of radius $R_1$, wherein some of said plurality of radial tick marks are labeled beginning with "5" and increasing counterclockwise ending with "100".

6. The circular calculator of claim 3, wherein said circular logarithmic source-to-film distance scale includes a plurality of radial tick marks emanating outward from a circle of radius $R_2$, wherein some of said plurality of radial tick marks are labeled beginning with "3" and increasing counterclockwise ending with "100".

7. The circular calculator of claim 6, wherein said circular logarithmic source-to-film distance scale displayed on said first disk is dimensioned in inches.

8. The circular calculator of claim 3, wherein said circular thickness scale includes a nearly linearly spaced radial tick marks emanating inward from a circumference of said second disk of radius $R_2$ beginning with 0 inches and increasing clockwise to 4 inches along said circumference for use with $Ir^{192}$ radiation sources.

9. The circular calculator of claim 8, wherein said radial tick mark F emanates from a circle of radius $R_3$, and wherein said radial tick mark F is positioned radially between 1 inches and 1.25 inches as displayed on said circular thickness scale.

10. The circular calculator of claim 3, wherein said circular thickness scale includes linearly spaced radial tick marks emanating inward from a circumference of said second disk of radius $R_2$ beginning with 0 inches and increasing clockwise to 8 inches along said circumference for use with $Co^{60}$ radiation sources.

11. The circular calculator of claim 3, wherein said radial baseline mark is rotationally adjustable from about −15° to about +45° relative to said zero reference point.

12. The circular calculator of claim 11, wherein said radial baseline mark is fixed in alignment with said zero reference point.

13. The circular calculator of claim 3, wherein said plurality of film type marks displayed on said third disk range from approximately 5:30 o'clock to approximately 9:30 o'clock when said radial baseline mark is in a 12 o'clock relative position.

14. A coplanar circular calculator for solving gamma radiography variables comprising:

a base for displaying a logarithmic time scale outside a circle of radius $R_1$, wherein said logarithmic time scale begins at a zero reference point;

a first annular ring of outer radius $R_1$, and inner radius $R_2$, coplanar with, and rotatably coupled to, said base and concentric with said logarithmic time scale for displaying a circular logarithmic radiation source strength scale and for displaying a circular logarithmic source-to-film distance scale;

a second annular ring of outside radius $R_2$, and inside radius $R_3$, coplanar with, concentric to, and rotatably coupled to, said first disk for displaying a circular thickness scale and for displaying a radial tick mark F; and a third disk of radius $R_3$, coplanar with, concentric to, and rotatably coupled to said second disk for displaying a radial baseline mark and for displaying a plurality of film type marks.

15. A method of calculating exposure time for gamma radiography using an apparatus for calculating gamma radiography variables given film type, source-to-film distance, object thickness, and radiation source strength comprising:

providing an apparatus for calculating gamma radiography variables including a base, a first disk, a second disk and a third disk;

selecting a film type corresponding to film being used from a plurality of film types radially marked along a circumference of said third disk on said apparatus;

rotating said second disk until a radial tick mark F on said second disk lines up with said selected film type mark;

rotating said first disk until a source-to-film distance marked on said first disk corresponding to distance between a radiation source and film for said radiograph lines up with object thickness of subject radiograph as marked on said second disk; and reading exposure time displayed on base of said apparatus corresponding to radiation source strength of said radiation source as displayed on said first disk.

16. A method of adjusting calculation of exposure time for gamma radiography using an apparatus for calculating gamma radiography variables to obtain density between 2.75 and 3.0 comprising:

providing an apparatus for calculating gamma radiography variables including a base, a first disk, a second disk, a third disk and radiographic film placed for exposure;

setting a radial baseline mark on said third disk to a zero reference point;

selecting a film type corresponding to said radiographic film from a plurality of film types radially marked along a circumference of said third disk of said apparatus;

rotating said second disk until a radial tick mark F lines up with said selected film type mark;

rotating said first disk until a source-to-film distance corresponding to distance between a radiation source and said radiographic film marked on said first disk lines up with object thickness of subject radiograph;

selecting calculated exposure time displayed on base of said apparatus corresponding to radiation source strength of said radiation source as displayed on said first disk;

exposing said radiographic film based on calculated exposure time;

developing a radiograph;

determining density of said developed radiograph;

adjusting said radial baseline mark clockwise up to 45° relative to said zero reference point to increase density if determined density is below a range of 2.75 to 3.0;

adjusting said radial baseline mark counterclockwise up to −15° relative to said zero reference point to decrease radiograph density if determined density is above said range of 2.75 to 3.0; and repeating above steps as necessary to obtain a radiograph of density 2.75 to 3.0.

* * * * *